United States Patent [19]

Traverse et al.

[11] 4,321,966

[45] Mar. 30, 1982

[54] HIGH VERTICAL CONFORMANCE STEAM DRIVE OIL RECOVERY METHOD

[75] Inventors: Eugene F. Traverse; Albert D. Deibert, both of Ventura, Calif.

[73] Assignee: Texaco Inc., White Plains, N.Y.

[21] Appl. No.: 141,243

[22] Filed: Apr. 17, 1980

[51] Int. Cl.[3] ..... E21B 43/24; E21B 43/30

[52] U.S. Cl. ..... 166/245; 166/263; 166/272

[58] Field of Search ..... 166/245, 263, 272

[56] References Cited

U.S. PATENT DOCUMENTS

| | | | |
|---|---|---|---|
| 3,393,735 | 7/1968 | Altamira et al. | 166/245 |
| 3,476,182 | 11/1969 | Allen | 166/263 X |
| 3,903,966 | 9/1975 | Teasdale et al. | 166/245 |
| 4,166,501 | 9/1979 | Korstad et al. | 166/245 X |
| 4,166,502 | 9/1979 | Hall et al. | 166/245 X |
| 4,166,503 | 9/1979 | Hall et al. | 166/245 X |
| 4,166,504 | 9/1979 | Brown et al. | 166/263 X |
| 4,177,752 | 12/1979 | Brown et al. | 166/245 X |

*Primary Examiner*—Stephen J. Novosad

*Attorney, Agent, or Firm*—Carl G. Ries; Robert A. Kulason; Jack H. Park

[57] ABSTRACT

The vertical or both vertical and horizontal conformance of a stem drive process is improved by employing one or more infill wells between the injection well and production well, the infill well being in fluid communication with the bottom half or less of the formation. In the first step, petroleum is recovered from the infill well after oil production at the production well has proceeded to a predetermined point. After water cut of fluids being produced from the infill well reaches a predetermined value, the production well is converted from a production well to an injection well and steam is injected into the converted well while continuing recovering fluids from the infill well. When one infill well is employed in a more or less aligned arrangment between injection and production wells, the vertical conformance is improved. When one or more infill wells are utilized in a pattern comprising one or more injectors and one or more producers, both horizontal and vertical conformance is improved.

15 Claims, 10 Drawing Figures

INJECTION WELL
INFILL WELL
PRODUCTION WELL $\alpha = \beta = 0°$

INJECTION WELL
INFILL WELL
PRODUCTION WELL

HIGH VERTICAL CONFORMANCE STEAM DRIVE OIL RECOVERY METHOD

FIELD OF THE INVENTION

The present invention concerns a steam drive oil recovery method. More particularly, the present invention concerns a steam drive oil recovery method especially suitable for use in relatively thick, viscous oil-containing formations, by means of which viscous oil may be recovered from the formation with improved vertical conformance by reducing the tendency for steam channeling and overriding which reduces the amount of oil recovered from the formation.

BACKGROUND OF THE INVENTION

It is well recognized by persons skilled in the art of oil recovery that there are formations which contain petroleum whose viscosity is so great that little or no primary production is possible. Some form of supplemental oil recovery or enhanced oil recovery must be applied to these formations in order to decrease the viscosity of the petroleum to a level so it will flow or can be displaced through the formation to the production wells and from there recovered to the surface of the earth. Thermal recovery processes have been used successfully for recovering viscous oil from such formations, and steam flooding is the most successful thermal oil recovery method employed commercially. Steam may be utilized for thermal stimulation of viscous oil formations in what is referred to as a "huff and puff" technique in which steam is injected into a well, allowed to remain in the formation for a short period, after which oil is recovered from the formation by means of the same well as was used for steam injection. A somewhat more successful technique employs steam in a steam drive or steam throughput process in which steam is injected into the formation on a more or less continuous basis by means of an injection well and oil is recovered from the formation by a spaced apart production well. The technique is somewhat more effective in many applications than the single well steam stimulation process since it both reduces the viscosity of petroleum and displaces petroleum through the formation, thus encouraging oil production from a remotely located production well.

While this process is effective with respect to the portion of the formation through which the steam travels, poor vertical conformance is often experienced in steam drive oil recovery processes. A major cause of poor vertical conformance is that steam is less dense than other fluids present in the earth formation, and so steam migrates to the upper portion of the permeable formation and channels across the top of the oil formation to the remotely located production well. This is referred to in the art as steam override. Once steam override has occurred in the upper portion of a formation, the permeability of the steam swept zone is increased due to the desaturation or removal of petroleum from the portion of the formation through which steam has channeled. Thus, subsequently injected steam will migrate almost exclusively through the steam-swept channel and very little of the injected steam will move into the lower portion of the formation, and thus very little additional viscous petroleum will be recovered from the lower portion of the formation. While steam drive processes effectively reduce the oil saturation of the portion of the formation through which steam passes by a significant amount, the portion of the recovery zone between the injection and production system actually contacted by steam is often less than 50% of the total volume of that recovery zone, and so a significant amount of viscous petroleum remains in the formation after completion of the steam drive oil recovery process. The severity of the poor vertical conformance problem increases with the thickness of the oil formation, vertical permeability and with the viscosity of petroleum contained in the earth formation.

Steam drive oil recovery processes may also be used in more conventional, low viscosity oil-containing formation, and steam override is also encountered in these cases.

Since the viscosity of steam is much less than the viscosity of petroleum, poor horizontal conformance is also encountered in steam throughput processes. This further reduces the percentage of the total volume within the pattern of wells employed in steam drive processes actually swept by injected steam.

In view of the foregoing discussion, and the large deposits of viscous petroleum from which only a small portion of the in place petroleum can be recovered because of the horizontal and vertical conformance problems, it can be appreciated that there is a serious need for an improved steam drive oil recovery method suitable for use in recovering viscous petroleum from relatively thick formations, which results in improved vertical conformance.

SUMMARY OF THE PRIOR ART

U.S. Pat. No. 4,166,501, Sept. 4, 1979, describes an oil recovery process employing an injection well and a production well with an infill well being located in the recovery zone between the injection well and production well. Steam is injected into the injection well and oil recovered from the production well until steam breakthrough occurs at the production well, after which the infill well is converted from a producer to an injector, and steam is injected into the infill well with production being continued from the production well. The result achieved by application of this process includes a significant increase in the vertical conformance of the steam drive oil recovery process.

U.S. Pat. Nos. 4,166,502; 4,166,503; 4,166,504; and 4,177,752 describe variations in the steam drive enhanced oil recovery process employing infill wells described above.

SUMMARY OF THE INVENTION

Our invention concerns a method of recovering petroleum especially viscous petroleum from a subterranean, petroleum-containing formation, said formation being penetrated by at least two wells, one injection well and one production well, both of said injection and production wells being in fluid communication with a substantial portion of the formation, said injection and production wells defining a recovery zone within the formation, comprising: penetrating the formation with at least one infill well located within the recovery zone and in fluid communication with no more than the lower 50% of the formation; injecting a thermal oil recovery fluid comprising steam into the injection well and recovering fluids including petroleum from the formation by the production well until a predetermined portion of the formation has been swept by steam; thereafter recovering fluids including petroleum from the formation by the infill well; thereafter converting the production well into an injection well and injecting thermal recovery fluid comprising steam into the converted well and recovering fluid from the infill well while injecting a fluid into the original injection well at a sufficient rate to maintain a positive pressure gradient between the injection well and the infill well.

DESCRIPTION OF THE PREFERRED EMBODIMENTS

Figure 1:
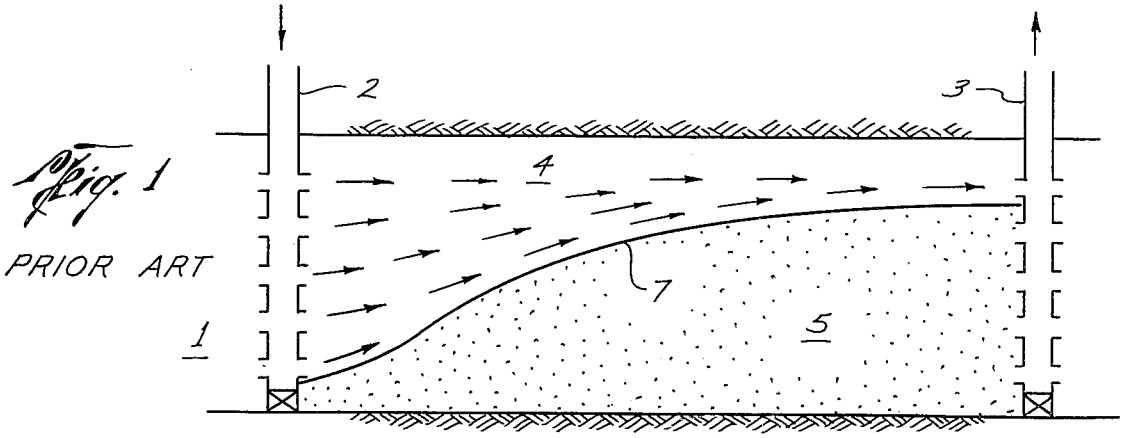
Fig. 1 PRIOR ART
FIG. 1 illustrates a vertical plane view of a subterranean formation penetrated by an injection well and a production well in a state-of-the-art steam drive oil recovery method such as is taught in the prior art, illustrating how the injected steam migrates to the upper portion of the formation as it travels through the recovery zone within the formation between the injection well and production well. The action of steam overriding and bypassing a significant amount of the petroleum saturated portion of the oil recovery zone is shown in this drawing.

The problem of steam override which occurs inherently in prior art steam drive enhanced oil recovery processes, for which the process of our invention is intended as an improvement, is best understood by referring to FIG. 1, which illustrates how a relatively thick, viscous oil-containing formation 1 is penetrated by an injection well 2 and a production well 3 in a conventional steam drive oil recovery process as is taught in the prior art. Steam is injected into the formation via well 2, passing through the perforations in well 2 and out into the viscous oil formation. Conventional practice is to perforate or establish fluid flow communication between well 2 and the formation throughout the full vertical thickness of the formation, both with respect to injection well 2 and production well 3. Notwithstanding the fact that steam is injected into the full vertical thickness of the formation, it can be seen that steam migrates in an upward direction as it moves horizontally through the formation while passing from well 2 toward production well 3. The result of this movement is the creation of a steam swept zone 4 in the upper portion of the formation and zone 5 in the lower portion of the formation through which little or no steam has passed. Since little or no steam has passed through zone 5, very little oil has been recovered from zone 5. Once steam breakthrough at production well 3 occurs, continued injection of steam into the formation via well 2 will not cause any significant amount of steam to flow into section 5 for the following two reasons.

(1) The specific gravity of vapor phase steam is significantly less than the specific gravity of petroleum and other liquids present in the pore spaces of the formation; therefore, gravitational forces will cause steam vapors to be confined largely to the upper portion of the formation. This phenomenon is referred to in the art as "steam override".

(2) Steam passing through the upper portion of the formation displaces and removes petroleum from the pore spaces of that portion of the formation, thus desaturating the zone and increasing the relative permeability of that portion of the formation significantly as a consequence of removing viscous petroleum therefrom. Thus, any injected fluid will travel even more readily through the desaturated portion 4 of the formation than it will through the portion 5 which is near original viscous petroleum saturation level.

Figure 2:
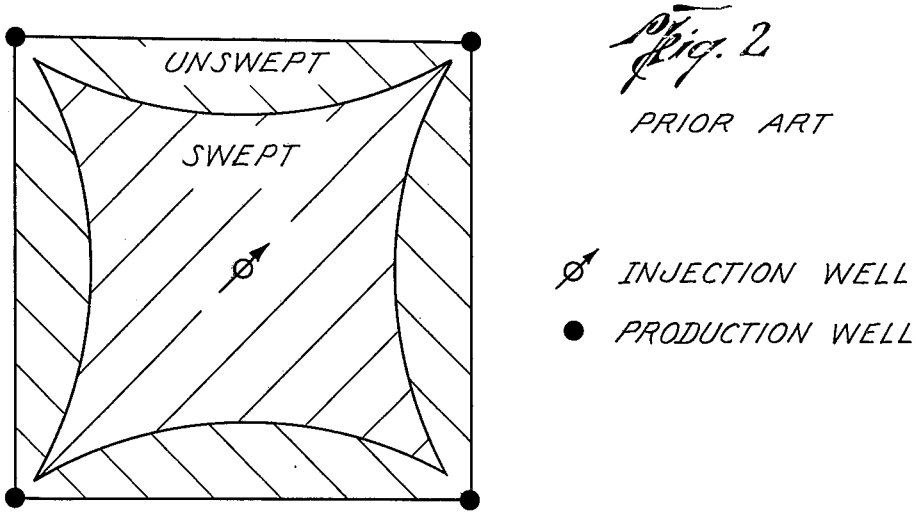
Fig. 2 PRIOR ART
FIG. 2 illustrates the swept and unswept portion of a formation in a horizontal plane in an inverted five spot pattern comprising one central injection well and four corner production wells, illustrating the poor horizontal conformance in a typical steam drive method practiced according to the prior art.

FIG. 2 illustrates the view of the swept and unswept zones in a typical inverted five spot pattern, as viewed in a horizontal plane. The swept portion commonly amounts to only about 60–70% of the total area of the pattern defined by the wells employed for the steam drive processes.

Figure 3:
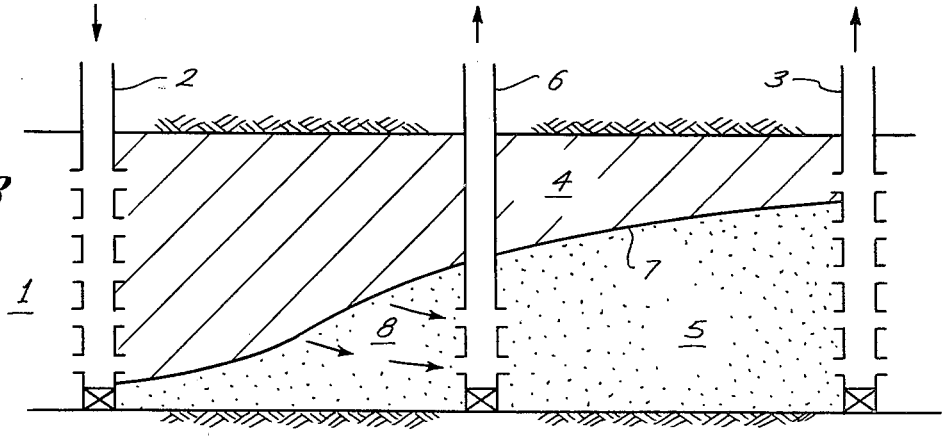
FIG. 3 illustrates the location of an infill well between an injection well and a production well and its use in the second phase of the process of our invention, after completion of a first phase comprising injecting steam into the injection well and producing fluids from the producing well. In the second phase, steam injection into the injection well is continued and petroleum and other fluids are recovered from the formation by means of the infill well, all as viewed in a vertical plane.

FIG. 3 illustrates how infill well 6 is drilled into the formation, with respect to original injection well 2 and production well 3. FIG. 3 illustrates the most basic embodiment of the process of our invention. Infill well 6 must be drilled into the recovery zone within the formation defined by injection well 2 and production well 3. It is conveniently located on a line between injection well 2 and production well 3, although it is not essential that it be so aligned and may be offset in either direction from a straight line arrangement. Similarly, it is certainly not essential that infill well 6 be located exactly midway between injection well 2 and production well 3, and it is adequate for our purpose if the distance between injection well 2 and infill well 6 be from 25–75% and preferably from 40–60% of the distance between injection well 2 and production well 3. Infill well 6 is perforated, or fluid flow communication between the well and the formation is established by other means, only in the lower 50% and preferably lower 25% of the oil formation. Confining the communication in the infill well to the lower portion of the formation is critical to the proper functioning of our process.

It is immaterial for the purpose of practicing our process whether infill well 6 is drilled and completed at the same time injection well 2 and production well 3 are drilled and completed, or if such drilling and completion of infill well 6 is deferred until sometime after initiating steam injection into injection well 2 and recovering displaced petroleum from production well 3. If infill well 6 is completed prior to its use, it is simply shut in during the first phase of our invention. It is usually economically preferable to defer drilling and completing infill well 6 until just prior to the time when it will be first used in the process of our invention. Also, by deferring drilling the infill well, it is easier to evaluate steam front advance, and ensures that the infill well is completed below the steam zone.

The fluid injected into injection well 2 during the first stages of the process of our invention described herein, as well as that injected into converted well 3 during latter stages of the process of our invention, will ordinarily comprise steam, either alone or in combination with some other substance which improves the effectiveness of steam drive oil displacement. For example, non-condensable gases such as nitrogen or carbon dioxide may be mixed or co-mingled with steam injected into the formation for the purpose of improving oil recovery efficiency. Miscible fluids, such as hydrocarbons in the range of C1 to C10, may be mixed with the steam, usually in the concentration range of from 1–25 and preferably 5–10% by weight. The presence of hydrocarbons co-mingled with steam injected into a viscous oil formation improves the effectiveness of the injected fluid for reducing oil viscosity and therefore improves the oil displacement effectiveness of the process. In yet another embodiment, air and steam are co-mingled in the ratio of from 0.05–2.0 standard cubic feet of air per pound of steam, which accomplishes a low temperature, controlled oxidation reaction within the formation and achieves improved thermal efficiency under certain conditions. So long as a major portion of the fluid injected into injection well 2 comprises vapor phase steam, the problem of steam override and channeling will be experienced in the steam drive oil recovery process no matter what other materials are included in the injected fluid in addition to steam, and the process of our invention may be applied to any steam drive oil recovery process with the resultant improvement of vertical conformance or both vertical and horizontal conformance.

Turning again to the drawings, our invention in its broadest aspect comprises a steam drive oil recovery process requiring a minimum of three steps. FIG. 3 illustrates a minimum three well unit required for application of the process of our invention, wherein viscous petroleum containing formation 1 is penetrated by an injection well 2, which is preferably in fluid communication with essentially the full vertical thickness of the formation. Spaced-apart production well 3 is a conventional production well, which is also preferably in fluid communication with essentially the full vertical thickness of the formation. Infill well 6 is shown located about midpoint between injection well 2 and production well 3, and penetrating the recovery zone defined by wells 2 and 3, i.e. infill well 6 may be on or adjacent to a line between wells 2 and 3 as viewed in a horizontal plane. Fluid communication is established between infill well 6 and the lower portion of the formation, in this instance being approximately the bottom 40% of the total thickness of the formation.

In the first step, a thermal recovery fluid comprising steam is injected into the formation by means of injection well 2. Steam enters the portion of the formation immediately adjacent to well 2 through all of the perforations in that well, and initially travels through substantially all of the full vertical thickness of formation 1. Because the specific gravity of vapor phase steam is significantly less than the specific gravity of viscous petroleum and other liquids normally present in pore spaces of formation 1, steam vapors migrate in an upward direction due to gravitational effects, and as can be seen in FIG. 1, the portion 4 of formation 1 swept by steam vapor in the first step represents an ever decreasing portion of the vertical thickness of the formation as the steam travels between the injection well 2 and production well 3. Thus, by the time steam arrives at production well 3, only a small fraction of the full vertical thickness of the formation is being contacted by steam. Oil is recovered from the portion of the formation through which the steam vapor travels, although the total recovery from the recovery zone defined by wells 2 and 3 will be significantly less than 50% of the total amount of petroleum in the recovery zone, due mainly to the poor vertical conformance of the steam drive oil recovery process. Even though significantly more than 50% of the oil present in portion 4 of the formation is recovered by steam, the large amount of oil remaining unrecovered from portion 5 through which little or no steam passes causes the total recovery efficiency to be low. The recovery efficiency is, therefore, highly influenced by the thickness of the formation, the well spacing, the viscosity of petroleum present in the flow channels of the formation, and vertical permeability as well as by other factors. Recoveries substantially below 50% are not uncommon in the field application of steam drive processes.

The first step of our processes comprises injecting steam into injection well 2 and recovering fluid from the formation by means of producing well 3 as is normally practiced in current state-of-the-art steam drive processes according to prior art teachings. The point at which this step is terminated is subject to several variations. Steam injection into injection well 2 and recovery of petroleum from well 3 may be continued until live steam production occurs at well 3, indicating that the steam swept zone has been developed all the way from injection well 2 to production well 3. This is a convenient method of operating but it does not necessarily represent the most efficient way of operating since the breakthrough of steam will also ensure that the high permeability, desaturated zone 4 will have extended all the way to the upper communication perforations of well 3. This diminishes somewhat the efficiency of subsequent portions of our process. Accordingly, in an especially preferred embodiment, production of fluids from well 3 is terminated prior to the breakthrough of live steam at that well. This may be signaled by monitoring the temperature of fluid being recovered from the well and terminating fluid production when the temperature reaches a value which is about 60 and preferably about 85% of the temperature of saturated steam at the pressure existing in the formation adjacent to the production well. In a large field, the amount of steam which is injected into a formation to the time when breakthrough of steam at a production well under given well spacing conditions is known quite precisely, and in another preferred embodiment, fluid production from well 3 is terminated when the amount of steam injected into well 2 is from 70 to 95 and preferably 80 to 90% of the amount of steam which would cause steam breakthrough at the production well.

Once the first stage of our process is terminated according to any of the criteria discussed above, infill well 6 is utilized for the first time. This well may have been drilled and completed at the same time wells 2 and 3 were drilled or at any time subsequent thereto and prior to the time the second phase of this process is begun. Well 6 in this embodiment is completed only as a production well, and as stated herein fluid communication between well 6 and only the bottom 50 and preferably bottom 25% of the formation is established. The second step of the process of our invention comprises taking production of fluids from well 6. It should be understood that a significant amount of oil is recovered from the formation by this step alone which is not recovered at the economic conclusion of the first step. Not only is oil recovered from a volume segment 8 of the recovery zone through which steam does not pass and from which oil is not recovered in a normal steam drive process such as is illustrated in FIG. 1, we have found that the oil saturation of zone 8 of FIG. 3, that being the portion of the recovery zone between the infill 6 well and injection well 2 occupying the lower thickness of the formation, will actually have increased during the period of recovering oil from swept zone 4 during the first phase of our process. This increase in oil saturation is caused by migration of oil mobilized by injected steam, into the portion of the formation such as segment 8 through which steam does not travel during the first period. Thus, if the average oil saturation throughout viscous oil formation 1 is in the range of about 55% (based on the formation pore volume), the injection of steam into the formation may reduce the average oil saturation throughout depleted zone 4 to 15% or less, but the oil saturation in zone 8 may actually increase to a value from 60–70%. The second step of the process of our invention, in which fluids are recovered from infill well 6, accomplishes steam-stimulated recovery of petroleum from zone 8 in FIG. 3 which is not recoverable by simple steam drive oil recovery processes such as those illustrated in FIG. 1. Because fluid communication only exists between well 6 and the lower portion of a formation, no more than the lower 50% and preferably no more than the lower 25% of the formation, movement of oil into these formations results in sweeping a portion of the formation not otherwise swept by steam, and accomplishes recovery of a significant additional amount of petroleum.

During the above described second step of the process of our invention, steam injection into well 2 must be continued. Production of fluids from well 3 may be continued at the previous production rate or at a decreased rate, or may be discontinued altogether depending on the water cut of the fluid being produced from that well at that time. If the water cut rises to a particularly high value at this time, well 3 should be shut in in order to avoid excessive lifting costs of producing large amounts of water from the formation via well 3.

Ordinarily, the second step is continued until the water-oil ratio of the fluids being recovered from the infill well rises to at least 50% and preferably at least 75%.

Figure 4:
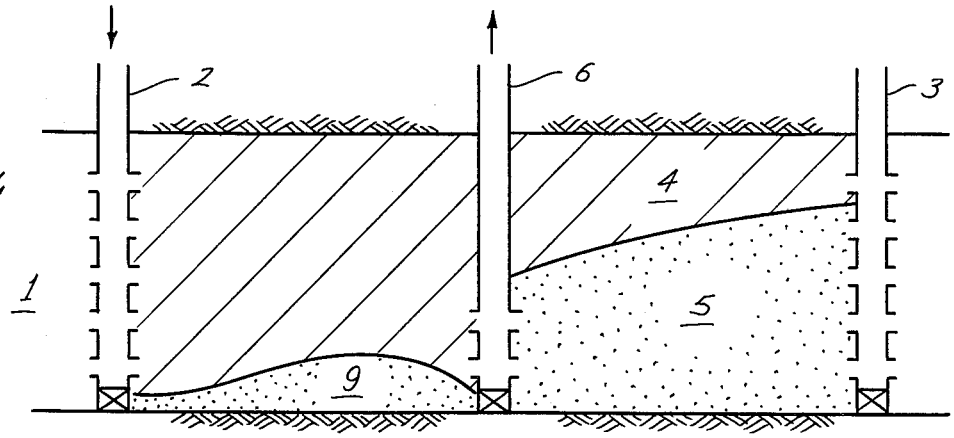
FIG. 4 illustrates the swept and unswept portions of the oil formation at the conclusion of the second step of our process, before conversion of the original production well into an injection well and injection of steam thereinto has begun, illustrating the additional portion of the formation swept in the first stage of our process.
Figure 5:
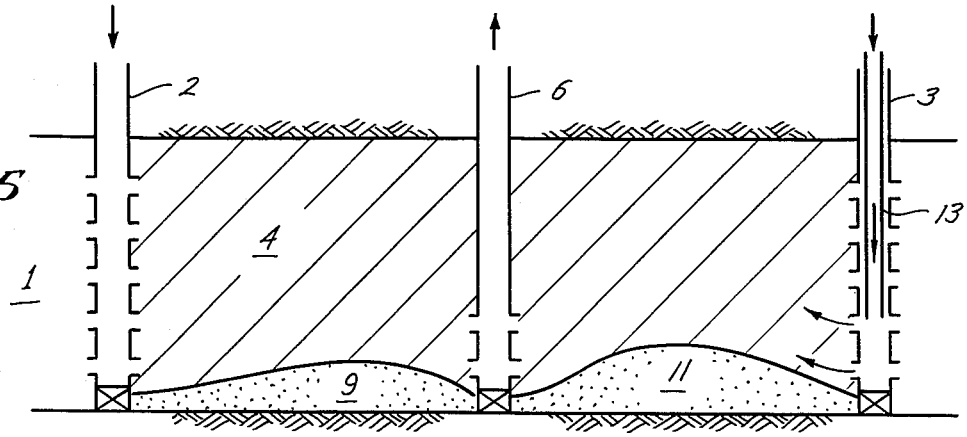
FIG. 5 illustrates the third step in the process of our invention in which the original production well has been converted to an injection well, and steam injection is being applied to the formation by this converted well with production being taken from the infill well.

It can be seen from FIG. 4 that at the conclusion of the second step of the process, the amount of the formation swept by steam has been increased significantly over that which is accomplished in prior art methods shown in FIG. 1; nonetheless, a significant portion 5 is still unswept by steam and little or no oil has been recovered from that portion of the formation. At or before this time, well 3 is converted from a production well to an injection well. Of course, conversion of well 3 can be done at any time during the second step while production is occurring at the infill well. It may be necessary or preferable to close off the upper perforations in well 3, although we have found in wells with tubing at the bottom of the interval, for reasons not fully understood, injection of steam into a well which is in fluid communication with the full vertical thickness of a formation, results in injection of most of the steam into the bottom portion of the formation adjacent to the well. This may be due to the fact that the end of the injection tubing was located very near the bottom of well 3, and accumulation of condensate and other fluids in the annular space between the casing of well 3 and the injection string 13 of FIG. 5 precludes passage of steam vapors from injection well 3 into the upper portions of the formation. Once well 3 has been recompleted as an injection well and injection spring 13 positioned at the desired depth, the thermal recovery fluid comprising steam is injected into the well and enters the lower portion of the formation as is shown in FIG. 5. Production of fluids from infill well 6 is continued during this period. Fluid injection into well 2 must also be continued during this period, although neither the fluid injected nor the pressure in which it is injected need be the same as in the first and second steps of our process. Steam injection may be continued, although other fluids may be injected since the principal reason for injecting fluids into injection well 2 at this stage of the process is to maintain the desired pressure gradient between well 2 and well 6 in order to prevent fluid movement in the direction from well 6 to well 2, which would cause resaturation of the portion of zone 4 between wells 2 and 6 and might also cause collapse of the steam front. If steam is used, the steam injection rate into well 2 need not be as great as it was in the period when it was the primary source of injected steam for stimulated oil production from wells 3 and/or 6, since it is only desirable to maintain a positive pressure gradient between wells 2 and 6. Other fluids may also be used, with an attendant savings in energy, since considerable energy is required to generate steam. Water may be injected into well 2, or inert gas such as carbon dioxide, natural gas, flue gas, etc. It is important that some fluid injection be maintained, however, to avoid movement of mobilized oil into the zone between wells 2 and 6 during the third phase of the process of our invention.

The above-described third stage comprising injecting steam into converted well 3 and recovering petroleum from well 6 while injecting sufficient fluid into well 2 to avoid resaturating the zone between wells 6 and 2 is continued until the water/oil ratio of the fluid being recovered from the formation via well 6 rises to an economically prohibitive level. For example, when the water/oil ratio rises to a value greater than 70 and preferably greater than 90, the third and final phase of the process of our invention is completed.

Figure 6:
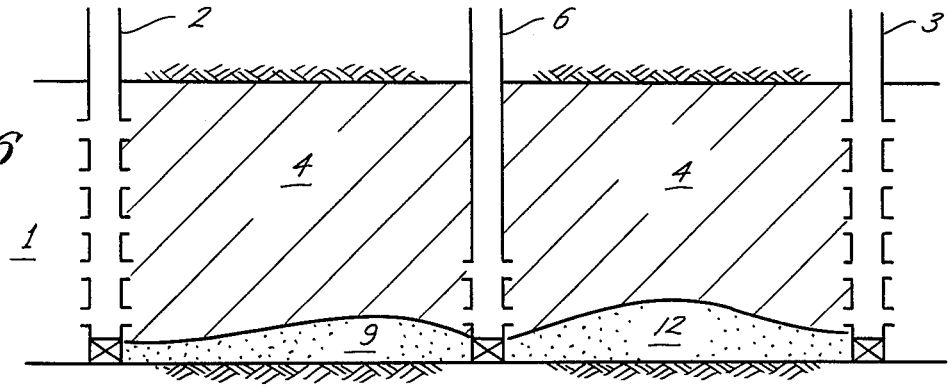
FIG. 6 illustrates the swept and unswept portion of the formation as viewed in a vertical plane, after completion of the third stage of the process of our invention.

FIG. 6 illustrates a typical situation existing after completion of stage 3, with swept zone 4 on both sides of well 6 being substantially greater than was possible in the case of the prior art technique shown in FIG. 1. A small formation segment 9 remains unswept between wells 2 and 6, and another small portion 12 remains unswept between wells 3 and 6, but the total portion of the formation swept by injected steam is significantly greater than is possible using prior art techniques.

Figure 8:
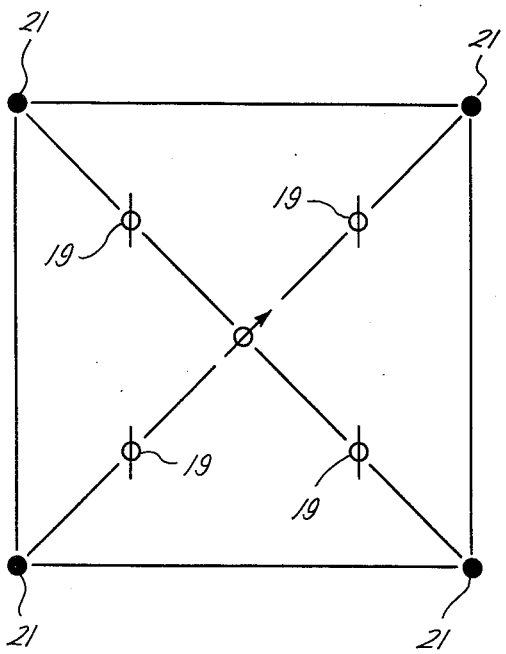
FIG. 8 illustrates an aerial view of an embodiment of our process being applied to an inverted five spot pattern with infill wells aligned with associated injection and production wells.
Figure 9:
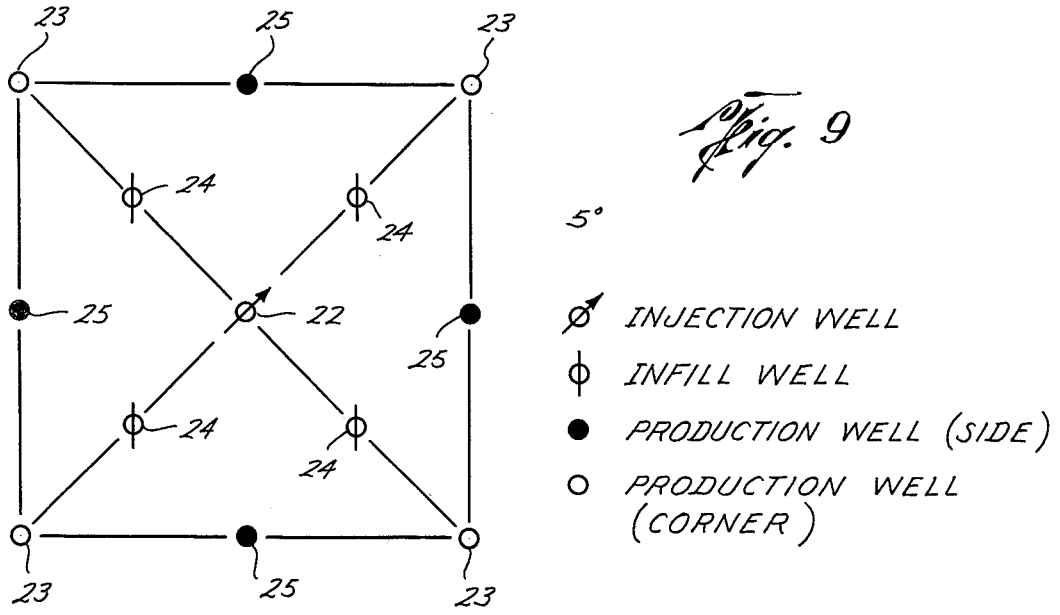
FIG. 9 illustrates an aerial view of an especially preferred embodiment of our process as applied to a nine spot pattern originally comprising a central injection well, four corner production wells, and four side production wells. The infill wells are located in an aligned configuration between the injection well and the four corner wells. In the second phase of the process of our invention, the corner wells are converted from production wells to injection wells, and steam is injected into these wells while continuing production from the infill wells and from the side production wells.

Two significant advantages associated with the processes of this invention are contrasted to the infill well processes described in the prior art section above. When infill well 6 is utilized as an injection well and well 3 is utilized as a production well in a steam drive process, the ratio of injection wells to production wells is higher than is the case in the present process. Reference to FIGS. 8 or 9 might suggest that no advantage exists in converting the corner producing wells to injection wells according to our process as contrasted to conversion of the infill wells to injection wells between the second and third stage. If only a single pattern is employed, this is true; however, in a large field, the total field development will be comprised of a large number of individual well patterns such as those shown in FIGS. 8 and 9. In those cases, in all patterns except those on the boundaries of the field, there will be identical patterns on all four sides of the square grid pattern shown in FIGS. 8 and 9, as well as four additional patterns in a diagonal direction between the central well and the corner producing wells. Thus, each corner producing well will be shared with four separate square grid patterns. Accordingly, for purpose of counting injection wells and production wells in a large field, in all except the patterns along the boundaries, each corner producing well will only count one-fourth of a well for each pattern. Accordingly, in converting the infill wells for FIG. 9, there will be four wells per pattern converted to injection well service, whereas when the corner wells are converted in a large field in which there are adjacent patterns in all directions from the grids shown in FIG. 8 or 9, only a total of one additional injection well per pattern will be added. The corner well conversion also maintains the pattern integrity and reduces pattern size by approximately 50% which reduces sweep time and improves vertical conformance. Specifically, in FIG. 8, if the infill wells are converted to injectors and the four corner producing wells are allowed to remain as producing wells, each producing well being shared with four patterns, the ratio of injection wells to production wells for FIG. 8 would be 5:1 after conversion of the infill wells to injection wells, whereas it would only be 2:4 if the corner wells were converted to injection wells and the infill wells were continued as producing wells according to our process. In FIG. 9, the ratio of injectors to producers in the instance of converting infill wells to injection wells is 5:3, since the corner wells are shared with four patterns and the side producing wells are shared with two patterns. By contrast, in the process of our invention, in which corner wells are converted to injectors and both infill wells and side producing wells are left as producers, the ratio of injection wells to producing wells is only 2:6.

There is yet another advantage in the process of our invention over the processes described in the prior art. Since thermal recovery processes involving injecting a hot fluid into a cold formation for the purpose of increasing the temperature and causing a related decrease in the viscosity of viscous petroleum contained in the formation, is basically a heat transfer system. Maximum heat efficiency is achieved when the hot fluid is being injected into the coldest parts of the formation. This is the situation which exists in the early stages of a conventional two well steam drive process such as that shown in FIG. 1. When steam injection is initiated into the infill well according to the above described prior art methods, however, the formation temperature adjacent the infill well is not as low as it is adjacent the bottom of production well 3 because of the passage of heated formation petroleum and ultimately steam into the infill well during the infill well production phase of those processes. Accordingly, heat transfer efficiency is greater when well 3 is converted from production well operation to injection well service for the third phase of the process of our invention as contrasted to conversion of the infill well from production well to injection well operation and continuing recovering fluid from the producing well.

Figure 7:
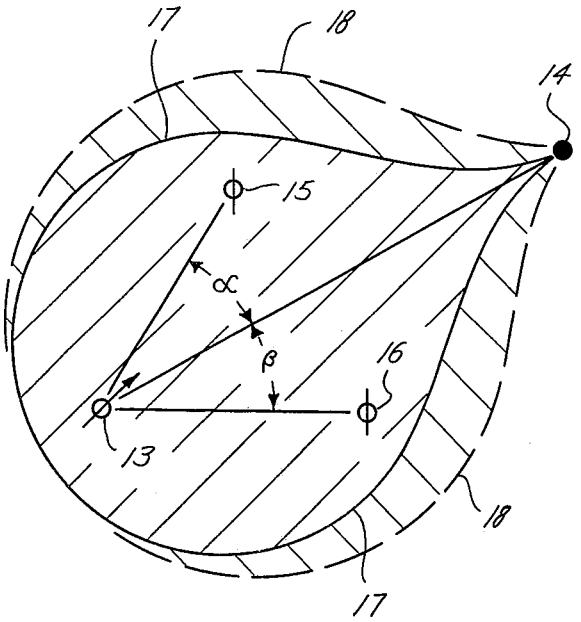
FIG. 7 illustrates the swept and unswept portion of a formation as viewed in a horizontal plane, with one injection well and one production well, illustrating the increased swept area when two infill wells each offset from a line between the injection and production wells are employed according to one embodiment of our invention.

The above described process, employing an infill well located on a line between the injection well and production well, effectively decreases the amount of steam override occurring in the formation and thus improves the vertical conformance, but does not improve the horizontal conformance of a steam throughput process in this simple two well model. Accordingly, the horizontal conformance may be improved in the embodiment of the present invention by positioning the infill wells in a strategically chosen portion of a pattern other than on a line between injection wells and production wells. This is illustrated in a simple embodiment of FIG. 7, showing the aerial view of injection well 13, production well 14, and infill wells 15 and 16 located on either side of a line between wells 13 and 14. The distance between injection well 13 and infill wells 15 and 16 is from 25–75% and preferably from 40–60% of the distance from the injection well to the producing well. The distance from the injector 13 to one infill well 15 is usually but not necessarily identical to the distance from the injector to the other infill well 16. The divergence in the location of infill wells 15 and 16 from a line between injection wells 13 and 14 is conveniently identified by angles alpha and beta. Ordinarily the infill wells are symmetrically disposed relative to line 13-14 so angle alpha will be equal to angle beta, but non-symmetrical arrangements are possible and may be preferred in certain situations. The value of alpha and beta may be from 0–80% and is preferably from 0–40%, depending on the pattern employed. The width of the recovery zone in FIG. 7 is increased from that defined by line 17 to the larger area defined by line 18 as a consequence of displacing the infill wells away from an aligned arrangement between wells 13 and 14.

FIG. 8 illustrates an embodiment of the present invention in which the infill wells 19 are located in aligned configuration between the injection well 20 and corner producing wells 21 of a conventional five spot pattern comprising a central injector in the center of a quadrilateral, preferably a square grid with a producing well located on each corner. This is a preferred embodiment for application to a large field since it accomplishes greater horizontal sweep efficiency than the pattern shown in FIG. 7. In yet another embodiment, not shown in the drawings the infill wells could be located 45 degrees from the aligned position.

FIG. 9 illustrates the especially preferred embodiment for application of the process of this invention to a large field development. In this pattern, the first stage comprises a conventional steam drive oil recovery process using a nine spot pattern with an injection well 22 located in the center of a quadrilateral, e.g. square grid, with four producing wells 23 located on the corners of the square and four additional producing wells 25 located at the midpoint of the sides of the square. This pattern is especially attractive because it has a favorable injector producing ratio (1:3 for the central patterns) and the horizontal sweep efficiency is quite good as a consequence of the geometrical arrangement of the producing wells around the injection well. In this instance, four infill wells 24 are drilled in an approximately aligned configuration between the central injector and the corner producing wells.

Figure 10:
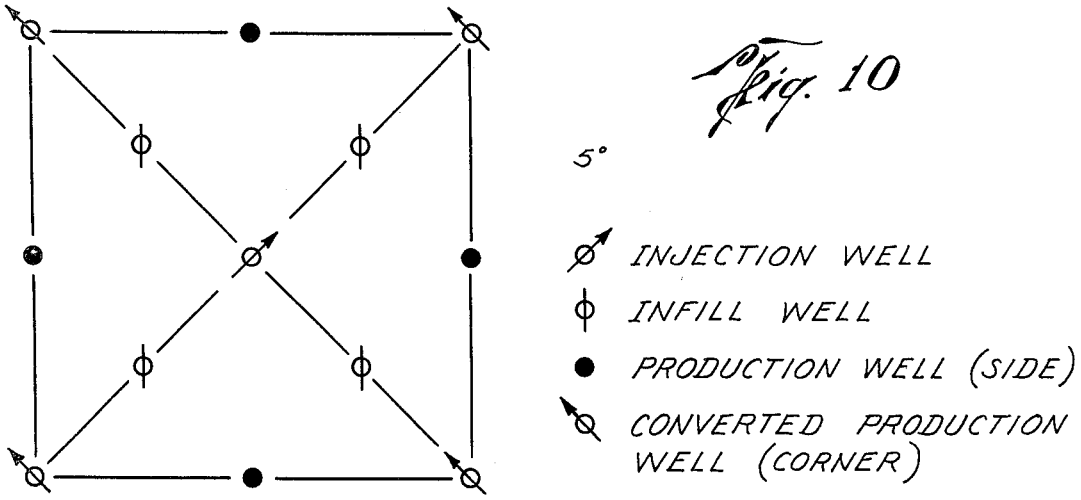
FIG. 10 illustrates an aerial view of the preferred embodiment of our process described in FIG. 9, after conversion of the corner wells from production wells to injection wells.

The first stage comprises injecting steam into the central injection well 22 and recovering oil from the four corner wells 23 and four side wells 25 until the end of the first phase occurs, followed by drilling and completing the infill wells 24 as shown in FIG. 9, completing them in the bottom 50% and preferably the bottom 25% of the formation, and recovering fluid from infill wells 24 while continuing injecting steam into the central injection well 22. The corner producing wells are then converted to injection wells as is shown in FIG. 10, and steam injection is then initiated into the corner wells 23 while continuing taking production from infill wells 24 and from side producing wells 25. Some fluid injection is continued in the central injection well 22, sufficient to insure the maintenance of a positive pressure gradient between that central injector and the infill wells.

Thus, we have disclosed how significantly more viscous oil may be recovered from an oil formation by a throughput, steam drive process employing the process of our invention with infill wells located between injection and production wells, and a multi-step process as described above. While our invention is described in terms of number of illustrative embodiments, it is clearly not so limited since many variations of the process will be apparent to persons skilled in the art of viscous oil recovery without departing from the true spirit and scope of our invention. It is our intention and desire that our invention be limited and restricted only by those limitations and restrictions appearing in the claims appended immediately hereinafter below.

We claim:

1. A method of recovering petroleum from a subterranean, petroleum containing formation, said formation being penetrated by at least two wells, one injection well and one production well, both of said injection and production wells being in fluid communication with a substantial portion of the formation, said injection and production wells defining a recovery zone within the formation, comprising:

(a) penetrating the formation with at least one infill well located within the recovery zone and in fluid communication with no more than the lower 50% of the formation;

(b) injecting a thermal oil recovery fluid comprising steam into the injection well and recovering fluids including petroleum from the formation by the production well until a predetermined portion of the formation has been swept by steam;

(c) thereafter recovering fluids including petroleum from the formation by the infill well; and (d) converting the production well into an injection well and injecting thermal recovery fluid comprising steam into the converted well and recovering fluid from the infill well while injecting a fluid into the original injection well at a rate sufficient to maintain a positive pressure gradient between the injection well and the infill well.

2. A method as recited in claim 1 wherein step (b) comprises injecting steam into the original injection well and recovering fluid from the production well until vapor phase steam production occurs at the production well.

3. A method as recited in claim 1 wherein step (b) comprises injecting steam into the injection well and recovering fluid from the production well until the temperature of the fluid being recovered from the production well rises to a value which is at least 60% of the temperature of saturated steam at the pressure existing in the formation adjacent to the production well.

4. A method as recited in claim 1 wherein step (b) is continued until the amount of steam injected into the injection well is sufficient to displace petroleum from 70 to 95% of the volume of the recovery zone from which petroleum would be recovered at the time of steam breakthrough.

5. A method as recited in claim 1 wherein recovery of fluid from the infill well is continued until the water cut reaches at least 50% prior to the initiation of injecting steam into the converted production well.

6. A method as recited in claim 1 wherein the distance from the injection well to the infill well is from 25–75% of the distance from the injection well to the producing well.

7. A method as recited in claim 1 wherein the distance from the injection well to the infill well is from 40–60% of the distance from the injection well to the producing well.

8. A method as recited in claim 1 wherein the infill well is located on a line connecting the injection well and the production well.

9. A method as recited in claim 1 wherein the infill well is located on a line which makes an angle of from 0–80 degrees with a line through the injection and production wells.

10. A method as recited in claim 1 wherein the infill well is located on a line which makes an angle of from 0–40 degrees with a line through the injection and production well.

11. A method as recited in claim 1 wherein the injection and production wells are part of a multi-well pattern comprising an injection well located at or near the center of a quadrilateral with four production wells on the corners of the quadrilateral and with at least one infill well located in the recovery zone between the injection well and each corner production well.

12. A method as recited in claim 1 wherein the thermal recovery fluid comprises steam and from 1 to 25% by weight hydrocarbons.

13. A method as recited in claim 1 wherein the fluid injected into the original injection well during step (d) comprises water, hot water, steam, or an inert gas.

14. A method of recovering petroleum from a subterranean, petroleum-containing formation, said formation being penetrated by at least two wells, one injection well and one production well, both of said injection and production wells being in fluid communication with a substantial portion of the formation, said injection and production wells defining a recovery zone within the formation, comprising:

(a) penetrating the formation with at least one infill well located within the recovery zone and in fluid communication with no more than the lower 50% of the formation;

(b) injecting a thermal oil recovery fluid comprising steam into the injection well and recovering fluids including petroleum from the formation by the production well;

(c) stopping recovering fluids from the producing well at a time prior to breakthrough of steam at the producing well; and thereafter (d) converting the production well into an injection well and injecting thermal recovery fluid comprising steam into the converted well and recovering fluids including petroleum from the formations via the infill well while injecting a fluid into the original injection well at a rate sufficient to maintain a positive pressure gradient between the injection well and the infill well.

15. A method of recovering petroleum from a subterranean, petroleum-containing formation, said formation being penetrated by a plurality of wells arranged in a pattern comprising a quadrilateral with an injection well at or near the center and a production well on each corner and a producing well in each side of the quadrilateral, all of said wells being in fluid communication with a substantial portion of the formation, said central injection well and corner production wells defining four recovery zones within the formation, comprising:

(a) penetrating the formation with at least one infill well located within each recovery zone and in fluid communication with no more than the lower 50% of the formation;

(b) injecting a thermal oil recovery fluid comprising steam into the central injection well and recovering fluids including petroleum from the formation by the production wells until a predetermined portion of the formation has been swept by steam;

(c) thereafter recovering fluids including petroleum from the formation by the infill wells; and (d) converting the corner production wells into injection wells and injecting thermal recovery fluid comprising steam into the converted well and recovering fluid from the infill wells while injecting a fluid into the original central injection well at a rate sufficient to maintain a positive pressure gradient between the injection well and the infill wells.

* * * * *